US005560106A

United States Patent [19]

Armbruster et al.

[11] Patent Number: 5,560,106

[45] Date of Patent: Oct. 1, 1996

[54] RESILIENT FLOATING HEAD RAZOR

[76] Inventors: Joseph M. Armbruster; Sue B. Armbruster, both of 2700 NE. 47th St., Lighthouse Point, Fla. 33064

[21] Appl. No.: 149,273

[22] Filed: Nov. 9, 1993

[51] Int. Cl.[6] ..... B26B 21/52

[52] U.S. Cl. ..... 30/527; 30/526

[58] Field of Search ..... 30/85–89

[56] References Cited

U.S. PATENT DOCUMENTS

| | | | |
|---|---|---|---|
| 1,089,726 | 3/1914 | Sharpnack . | |
| 1,450,604 | 4/1923 | Mossberg . | |
| 1,455,726 | 5/1923 | Hartman . | |
| 2,229,666 | 1/1941 | Monnet | 30/72 |
| 4,756,082 | 7/1988 | Apprille, Jr. | 30/89 |
| 5,046,249 | 9/1991 | Kawara et al. | 30/86 |
| 5,070,614 | 12/1991 | Hardin et al. | 30/87 |

*Primary Examiner*—Douglas D. Watts

*Attorney, Agent, or Firm*—Jacobson, Price, Holman & Stern, PLLC

[57] ABSTRACT

A razor structure incorporating a resilient connection between a razor handle and a razor head which enables the razor head to resiliently float in relation to the handle with the floating head being capable of resilient movement in all directions of movement in which the resilient characteristics of movement of the razor head exerts optimum blade pressure against the anatomical skin surface when the blade or blades on the razor head are oriented in optimum relation to the anatomical skin surface being shaved. A plurality of embodiments of the invention are disclosed with all embodiments enabling the razor head to move against a resilient bias, provided by a resilient, flexible body or component, in all directions or in the X, Y and Z planes.

16 Claims, 8 Drawing Sheets

RESILIENT FLOATING HEAD RAZOR

BACKGROUND OF THE INVENTION

1. Field of the Invention

This invention relates to a razor structure incorporating a resilient connection between a razor handle and a razor head which enables the razor head to resiliently float in relation to the handle with the floating head being capable of resilient movement in all directions of movement in which the resilient characteristics of movement of the razor head exerts optimum blade pressure against the anatomical skin surface when the blade or blades on the razor head are oriented in optimum relation to the anatomical skin surface being shaved. A plurality of embodiments of the invention are disclosed with all embodiments enabling the razor head to move against a resilient bias in all directions or in the X, Y and Z planes.

2. Description of the Prior Art

Razors for shaving hair from various anatomical skin surfaces have been developed, improved and marketed with most of the present day improvements relating to the shaving head which has a blade or multiple blades mounted in a molded plastic head structure. Developments include replaceable blade cartridges slidably or otherwise detachably connected to a supporting razor head. Also, disposable or throwaway razors have been developed in which the blade or blades are incorporated into a molded plastic head which is integral with and rigid with the handle. There has also been developed a razor in which the razor head which supports the changeable blade cartridge can pivot about an axis generally transverse to the longitudinal axis of the handle and parallel to the blade or blades mounted in the changeable head. One embodiment of this type of razor is marketed by Gillette Company and identified by trademark "SENSOR".

The following U.S. patents relate to various developments in the safety razor art which relate to this invention.

| | | |
|---|---|---|
| 1,089,726 | 4,854,043 | 4,587,929 |
| 1,450,604 | 3,880,284 | 4,621,424 |
| 2,229,666 | 4,026,016 | 4,742,909 |
| 4,756,082 | 4,083,104 | 4,756,082 |
| 5,070,614 | 4,168,571 | 4,379,219 |
| 1,455,726 | 4,270,268 | 4,624,051 |
| 4,170,821 | 4,488,357 | 4,807,401 |
| 4,047,296 | 4,492,024 | 4,916,817 |
| 4,205,437 | 4,492,025 | 4,683,096 |
| 4,344,227 | 4,498,235 | 4,697,342 |
| 4,797,998 | 4,551,916 | D290050 |
| Re: 30913 | 4,573,266 | D306216 |
| 4,409,735 | 4,586,255 | D312568 |
| 4,443,939 | | |

The prior art listed above includes various structures which enable relative movement of the razor head in relation to a rigid handle. However, the prior art does not disclose a floating razor head in which there is a capability of resiliently resisted movement in all directions in order for the floating razor head to resiliently move in relation to the handle in all three planes (X, Y and Z) of movement with the floating razor head also being capable of resilient movement in any direction in each of those planes.

SUMMARY OF THE INVENTION

An object of the present invention is to provide a resilient floating head razor in which a resilient connection is provided between a rigid handle and a razor head having a blade or blades mounted thereon which enables the floating razor head to move in any direction in relation to the handle with such movement being resiliently resisted in all directions.

Another object of the invention is to provide a razor in accordance with the preceding object in which the resilient resistance to movement of the razor head in relation to the handle causes optimum blade pressure to be exerted against the anatomical skin surface being shaved when the razor blade or blades mounted on the razor head are in the optimum angular relation to the anatomical skin surface being shaved and the hair shafts or whiskers extending outwardly from the skin surface for most effective severing of the hair shafts in extremely close proximity to the skin surface with minimum irritation of the skin surface by movement of the razor blade or blades over the surface.

A further object of the invention is to provide a razor in accordance with the preceding objects in which the resilient connection enables the razor head and the blade or blades thereon to move against resilient resistance in all directions and in all three planes with various embodiments of the resilient connection providing a structure that is economical to manufacture but yet quite effective in providing a resilient connection that greatly enhances the effectiveness and comfort factor in shaving an anatomical skin surface which has various contours.

Still another object of the invention is to provide a razor in accordance with the preceding objects in which the various embodiments can be incorporated into razors which can be manufactured in the manner of disposal razors now on the market or in the manner of more expensive razors having replaceable blade cartridges in which the resilient connection can be easily incorporated into presently marketed razors with minimum modification of production facilities.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
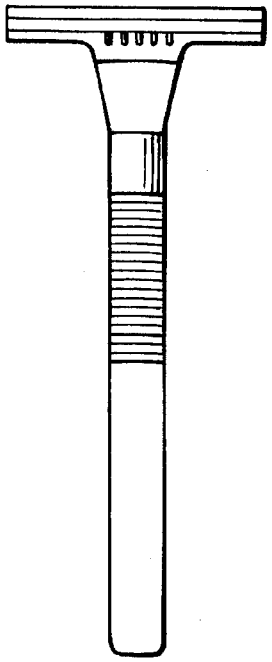
FIG. 1 is a plan view of a disposable razor incorporating a resilient connection in accordance with the present invention between the razor handle and razor head.

Referring to FIG. 1, a conventional disposable razor 10 is disclosed with the resilient connection of the present invention incorporated therein and designated by reference numeral 12. The razor 10 includes an elongated rigid handle 14 which may be of any conventional shape and configuration such as of circular configuration, rectangular configuration or the like. The razor 10 also includes a razor head 16 which normally is rigid with and integral with the handle 14. The razor head includes one or more razor blades 18 mounted therein. It is pointed out that the razor itself may take many configurations including configurations that are presently on the market regardless of the shape and material from which the handle is formed and regardless of the shape and material of which the razor head is formed and the resilient connection 12 may be incorporated into various types of razors including disposable razors and those which have replaceable blade cartridges or replaceable blades.

Figure 2A:
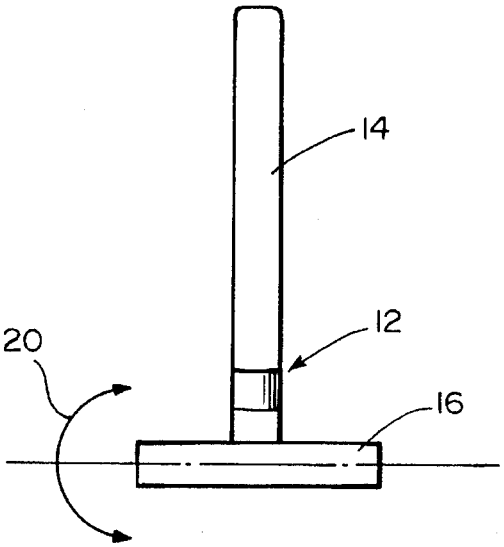
FIG. 2 includes a top, front and side schematic views illustrating the movement capabilities of the floating head permitted by the resilient connection of the present invention.
Figure 2B:
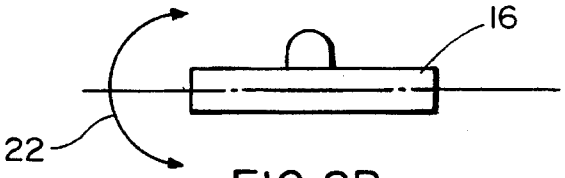
Figure 2C:
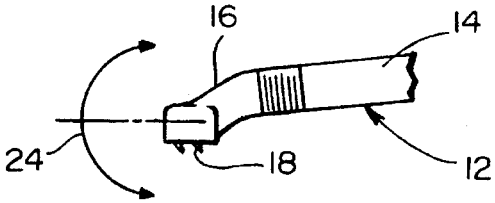

FIG. 2 illustrates schematically the movement capability between the handle 14 and the razor head 16 permitted by the resilient connection 12. In the top view, the razor head 16 can move in the direction of the arcuate line 20 in the direction of arrow heads on the arcuate line 20. In the front view, the razor head 16 can move in the direction indicated by arcuate line 22 in the direction of the arrow heads on the line 22. In the side view, the razor head 16 can move in the direction of the arcuate line 24 in the direction of the arrow heads at the end of the arcuate line 24. Thus, the razor head 16 can move in all three planes (the X, Y and Z planes) and can move in any direction in each of the three planes.

Figure 3:
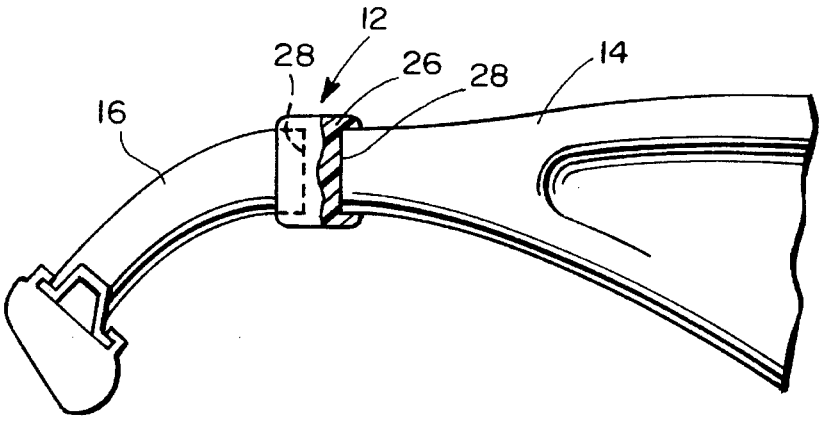
FIG. 3 is an enlarged fragmental sectional view of the resilient connection in the razor of FIG. 1.

FIG. 3 illustrates the specific structural details of an embodiment of the resilient connection designated by reference numeral 12 in FIG. 1 in which the handle 14 is slightly different in shape from that illustrated in FIG. 1. The resilient connection 12 in FIG. 3 is a cylindrical body 26 of resilient material such as resilient plastic material or similar material in which the two ends of the body 26 each have a cavity 28 with one cavity 28 receiving the end of the handle 14 and the other cavity 28 receiving the end of the razor head 16. The ends of the razor handle 14 and razor head 16 are secured in the recesses or cavities 28 by a bonding agent or by a heat or sonic welding procedure in order to fixedly connect the ends of the resilient body 26 with the aligned ends of the handle 14 and razor head 16. The resilient body then will permit resilient movement of the razor head 16 in relation to the handle 14 in any direction and in any plane with all movement of the razor head relative to the razor handle being resiliently resisted by the resilient characteristics of the resilient body 26.

Figure 4:
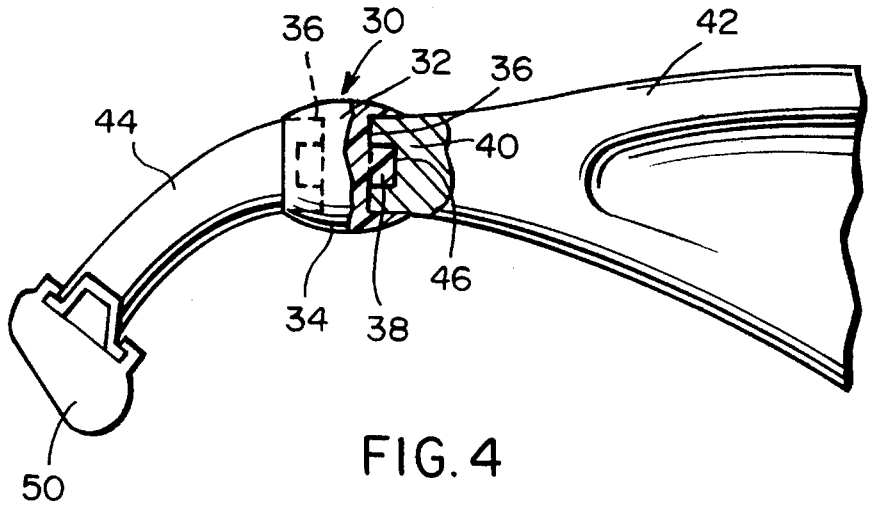
FIG. 4 is a fragmental sectional view illustrating another embodiment of the resilient connection in FIG. 1.

FIG. 4 illustrates another embodiment of the resilient connection designated by reference numeral 30 and which includes a resilient body 32 having an oval shaped or curved external surface 34. Each end of the body 32 is provided with a recess 36 of cylindrical configuration that has a centrally located axial projection 38 therein in which the recess 36 receives the end portion 40 of a handle 42 and the other recess 36 receives the end portion of a razor head 44 in which the end of the handle 42 and the razor head 44 is provided with a central recess 46 which receives the axial projection 38 on the resilient body 32. FIG. 4 also illustrates a razor handle 42 that includes diverging top and bottom surfaces with a central recess and the razor head 44 includes a replaceable blade cartridge 50. The specific construction of the resilient body 32 provides additional surface areas to enhance the bonded connection between the resilient body 32 and the handle 42 and razor head 44.

Figure 5:
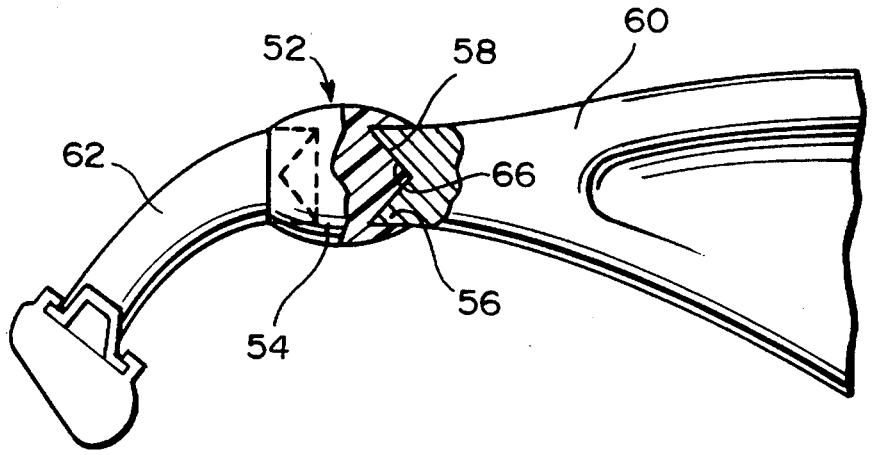
FIG. 5 is a fragmental sectional view illustrating another embodiment of the resilient connection in FIG. 1.

FIG. 5 illustrates another embodiment of the resilient connection 52 which includes a body of resilient material 54 similar in oval shape configuration to that illustrated in FIG. 4. In this embodiment of the invention, each end of the resilient body 54 is provided with a recess 56 that includes a central axial projection that is generally conical in configuration as compared to the projection in FIG. 4 which is of generally cylindrical configuration. The handle 60 and the razor head 62 includes a recess 66 which corresponds in configuration to the recess 56 which functions to provide an increased surface forming a bonding surface or area between the resilient body 54 and the handle 60 and razor head 62.

Figure 6:
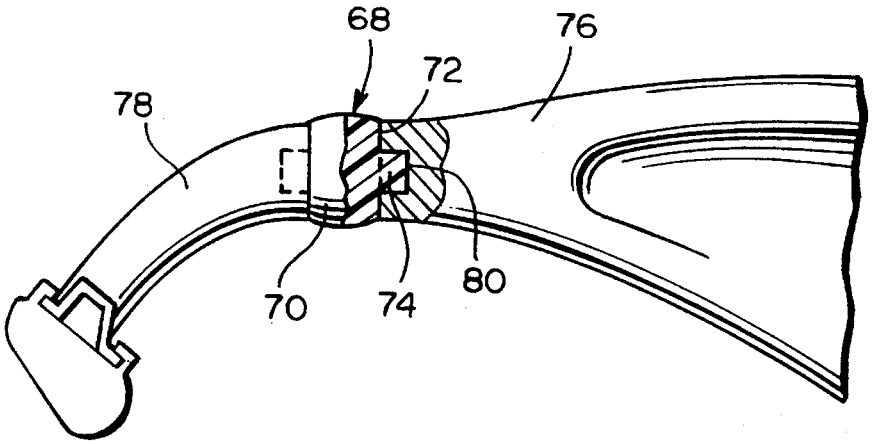
FIG. 6 is a fragmental sectional view of another embodiment of the resilient connection in FIG. 1.

FIG. 6 illustrates a resilient connection 68 including a resilient body 70 having an oval shaped curved external configuration and which has generally circular flat ends 72 provided with a centrally disposed axial projection 74 on each end thereof of generally cylindrical configuration. The handle 76 and razor head 78 have external perimeters generally equal to the external perimeter of the flat circular ends 72 and the end of the handle 76 and the end of the razor head 78 each includes a centrally disposed recess or cavity 80 corresponding with and receiving the projection 74 thereby providing an additional surface area for securely bonding the body 70 to the handle 76 and razor head 78.

Figure 7:
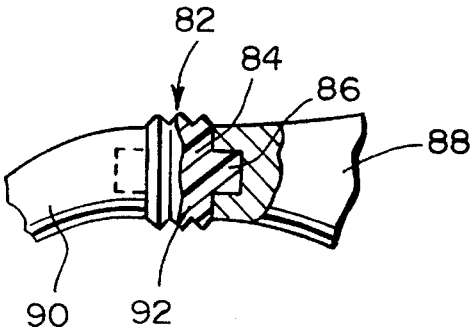
FIG. 7 is a fragmental sectional view illustrating another embodiment of the resilient connection.

FIG. 7 illustrates a resilient connection 82 including a resilient body 84 of resilient plastic or similar resilient material which includes flat ends and an axial projection 86 associated with the handle 88 and razor head 90 in the same manner as in FIG. 6. The external surface of the resilient body 84 is provided with a plurality of peripheral ridges and grooves 92 which effectively enhance the flexibility of the resilient body 84 with the grooves 92 providing relief areas peripherally of the body 84 to enable the body 84 to flex to a greater degree and with slightly less resilient resistance to flexing as compared to the embodiment illustrated in FIG. 6.

Figure 8:
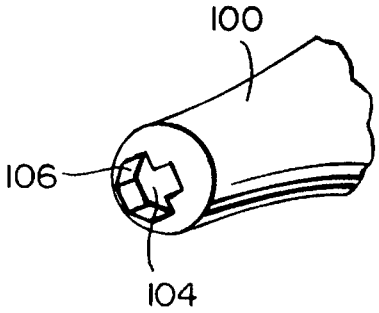
FIG. 8 is a fragmental sectional view of another embodiment of the resilient connection.
Figure 9:
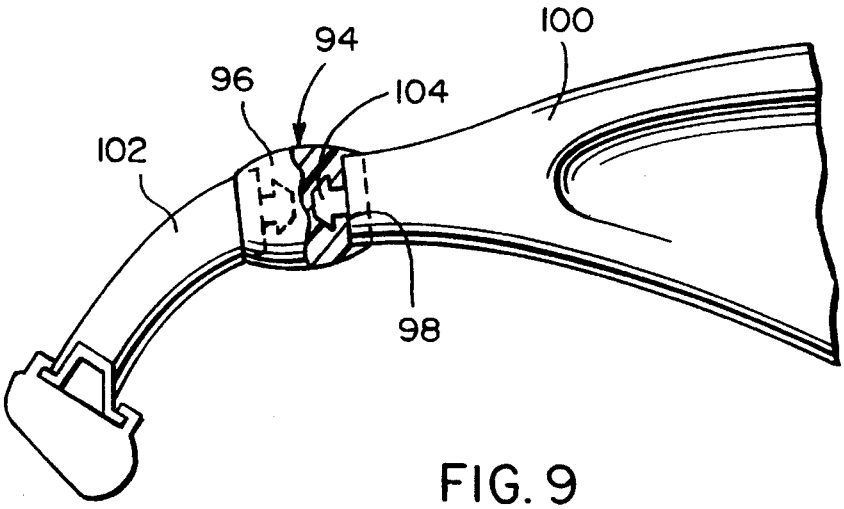
FIG. 9 is a fragmental prospective view of the structure of the end of the handle of the razor which engages the resilient connection.

FIGS. 8 and 9 illustrate a resilient connection 94 including a resilient body 96 having an oval shaped external configuration provided with a cylindrical recess 98 in each end which telescopically receives the end of the handle 100 and the end of the razor head 102 for bonding engagement. In this embodiment of the invention, the end of the razor handle 100 and the end of the razor head 102 each include an axial projection 104 which has parallel, planar side surfaces, a flat outer end and downwardly and outwardly inclined edge surfaces 106 which forms an arrow shaped configuration or a barb configuration which is inserted into the body 96 of resilient material as an additional anchoring structure between the body 96 and the handle 100 and the razor head 102.

Figure 10:
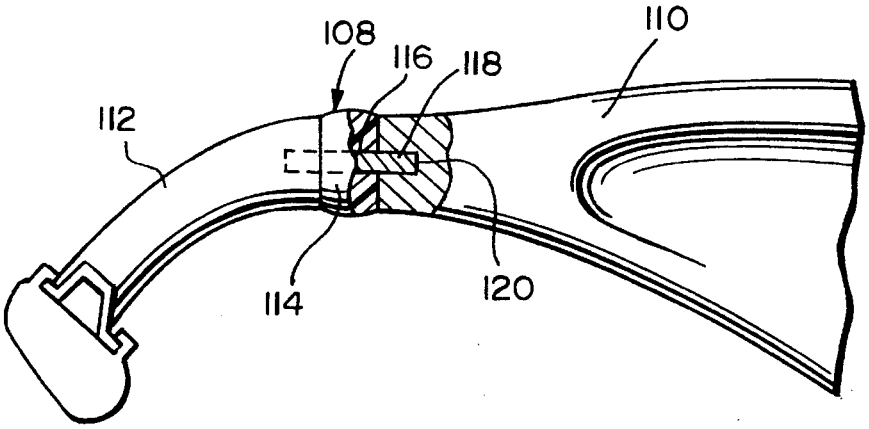
FIG. 10 is a fragmental sectional view of another embodiment of the flexible connection.

FIG. 10 illustrates a resilient connection 108 between the handle 110 and razor head 112 and which includes a resilient body 114 of flexible, resilient plastic material or the like having a generally cylindrical or oval shaped external configuration and provided with a centrally disposed passageway 116 receiving a flexible shaft 118 which extends into a recess 120 in the end of the handle 110 and the end of the razor head 112. The flexible shaft 118 is externally grooved, serrated or knurled for more effective bonding to the handle 110 and razor head 112.

Figure 11:
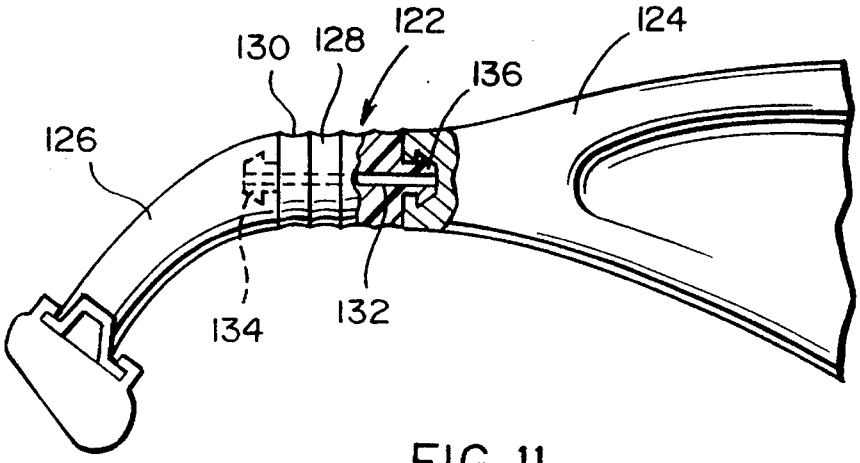
FIG. 11 is a fragmental sectional view of another embodiment of the resilient connection.
Figure 13:
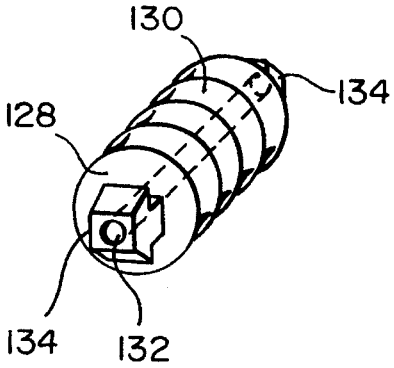
FIG. 13 is a perspective view of the resilient connection of FIGS. 11 and 12.
Figure 12:
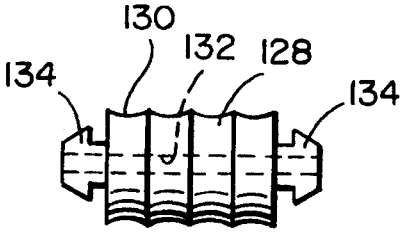
FIG. 12 is a side elevational view of the resilient connection in FIG. 11.

FIGS. 11–13 illustrate a resilient connection 122 between handle 124 and razor head 126 in which the resilient connection includes a resilient body 128 having a plurality of peripheral ridges and grooves 130 therein and a central passageway 132. Each end of the resilient body 128 is provided with an axial projection 134 of hook shaped or barb shaped configuration similar to the configuration of the projection 104 in FIG. 9 with the projection 134 being of resilient, plastic material and inserted into and received in a recess or cavity 136 in the end of the handle 124 and the end of the razor head 126 with the cavity 136 generally conforming in shape and configuration to the arrow head shaped projection or barbed projection 134.

Figure 14:
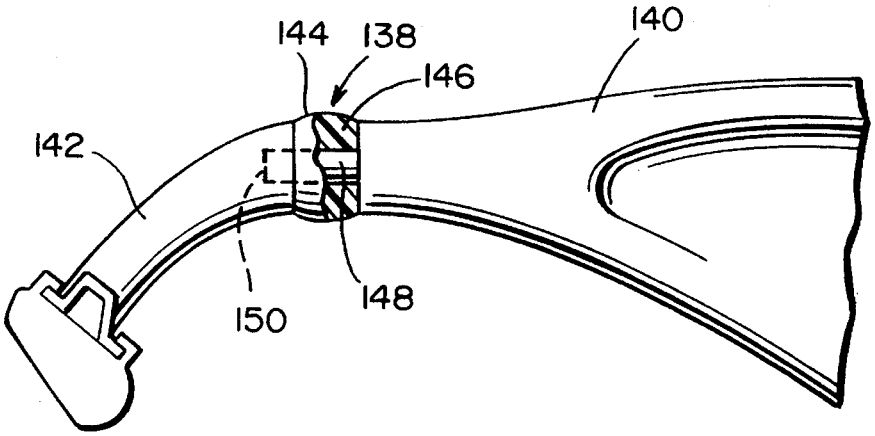
FIG. 14 is a fragmental sectional view illustrating another embodiment of the resilient connection.

FIG. 14 illustrates a resilient connection 138 between handle 140 and razor head 142 which includes a resilient body 144 of plastic or similar material having a cylindrical or oval shaped external configuration generally the same in diameter as the adjacent ends of the handle and razor head and including a central passageway 146 extending therethrough. The handle 140 is provided with a centrally disposed, axially extending shaft 148 which extends through the passageway 146 and into an inwardly extending cavity 150 in the razor head 142. The shaft 148 is constructed of plastic material having flexible resilient characteristics and is a living shaft similar in construction and function to a living hinge with the shaft 148 being integral with the handle 140.

Figure 15:
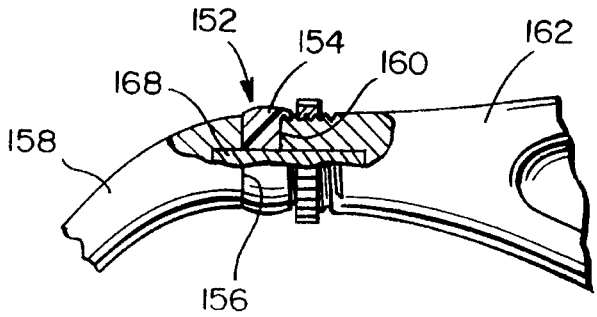
FIG. 15 is a fragmental sectional view illustrating an embodiment of the resilient connection in which the resilient characteristics of the connection can be varied.
Figure 16:
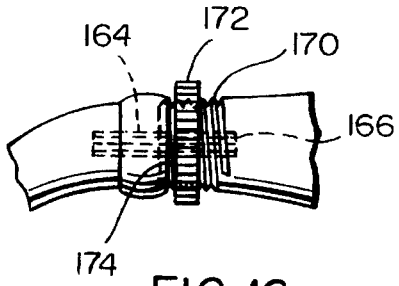
FIG. 16 is a fragmental side elevational view of the resilient connection of FIG. 15.

FIGS. 15 and 16 disclose a resilient connection 152 including a resilient plastic body 154 which has a flat end 156 engaging a corresponding flat end of a razor head 158 and a cavity 160 which receives the end of the handle 162. The body 154 includes a passageway 164 extending therethrough which receives a flexible living shaft 166 which is externally serrated, grooved or knurled which is also received in passageways 168 in the handle and razor head. The external surface of the handle 162 adjacent the resilient body 154 is externally threaded at 170 and receives a screw threaded nut 172 thereon which engages a flat washer 174 positioned between the nut 172 and the end of the resilient body 154. By tightening or loosening the nut 172 which may be externally grooved or threaded in the form of a thumb wheel, the resilient body 154 may be partially compressed or pressure applied thereto in order to vary the resilient characteristics of the body 154 thus varying the resilient resistance to free movement of the razor head in relation to the razor handle.

Figure 17:
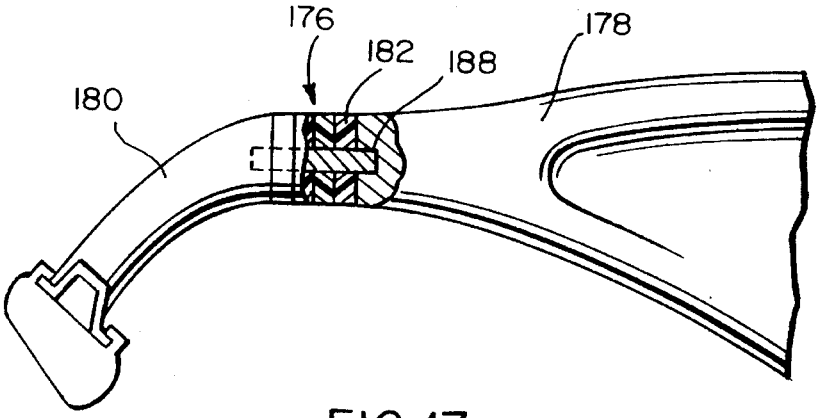
FIG. 17 is a fragmental sectional view of the resilient connection incorporating a plurality of resilient discs.
Figure 18:
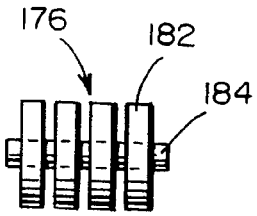
FIG. 18 is a side elevational view of the resilient connection of FIG. 17 illustrating the resilient discs spaced apart.
Figure 19:
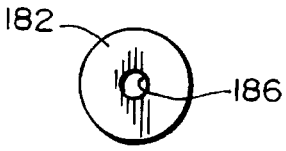
FIG. 19 is an elevational view of one of the resilient discs utilized in the resilient connection in FIG. 17.

FIG. 17–19 illustrate a resilient connection 176 between a handle 178 and a razor head 180 which includes a plurality of circular resilient discs 182 of plastic or similar material mounted on a flexible living shaft 184. Each of the discs 182 includes a central opening 186 receiving the shaft and the ends of the shaft project beyond the discs and are received in recesses 188 in the end of the handle 178 and in the end of the razor head 180 thereby providing an assembly in which the components of the assembly are bonded together and to the handle and razor head and the resilient characteristics of the resilient connection 176 can be varied by assembling discs or washers 182 having various hardness, resilient and flexible characteristics.

Figure 20:
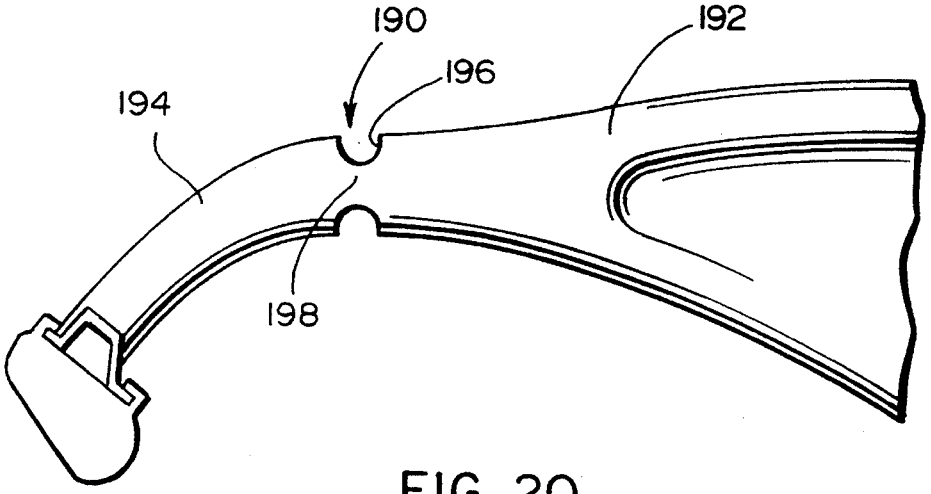
FIG. 20 is a side elevational view of a resilient connection in the form of a reduced area of plastic material forming a living hinge between the handle and razor head to permit resilient movement of the razor head in any direction.

FIG. 20 illustrates a resilient connection 190 between the handle 192 and razor head 194 in which the plastic material from which the handle 192 and razor head 194 are formed are reduced in diameter by forming a peripheral groove 196 which forms a living hinge area 198 of plastic material but enables the resilient connection 190 to be integral with the handle 192 and razor head 194 and enables resilient flexing or pivoting movement of the razor head 194 in all directions in relation to the handle 192.

Figure 21:
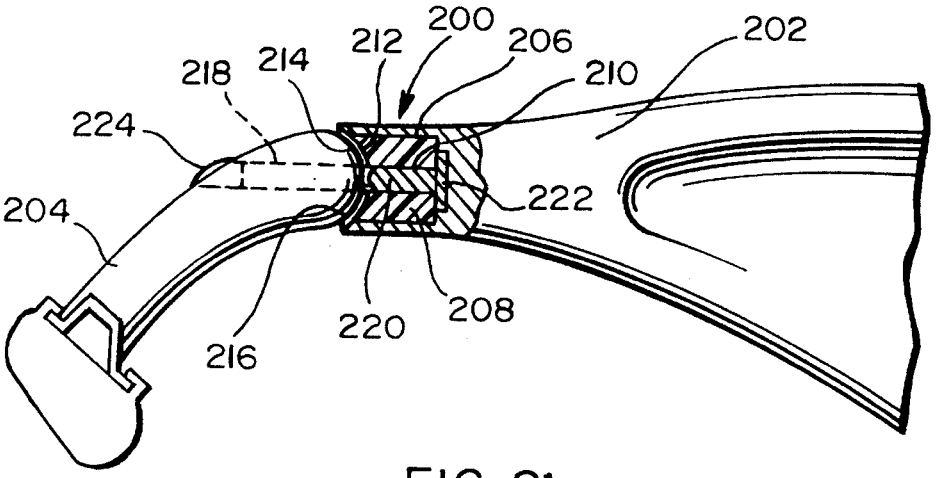
FIG. 21 is a fragmental sectional view of a resilient connection which includes a resilient insert within a cavity in the end of the handle.
Figure 22:
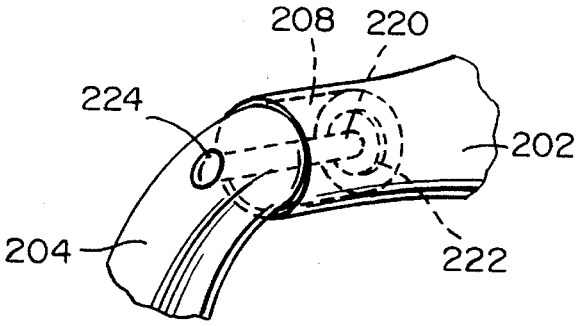
FIG. 22 is a fragmental perspective view of the resilient connection of FIG. 21.

FIGS. 21 and 22 illustrate a resilient connection 200 between handle 202 and razor head 204 in which the handle 202 is provided with a recess 206 which receives a resilient body 208 of plastic or the like having a central passageway 210 extending therethrough. The resilient body 208 is retained within the cavity or hollow interior of the handle 202 by inturned flanges 212 with the end edge of the body 208 and the flanges 212 being curved to form a concave, partial spherical surface 214. The razor head 204 is provided with an end surface 216 of similar shape and a passageway 218 which aligns with the passageway 210 and cooperates therewith to receive a flexible shaft 220 having a rounded end or head 222 thereon engaging the inner end of the resilient body 208. The end of the passageway 218 which communicates with the outer curved surface of the razor head is provided with a closure cap 224. The assembled structure is retained in place with the shaft 220 being bonded to the interior of the passageway 218 and the shaft 220 may be a rigid brass shaft with the resiliency being provided by the characteristics of the resilient body 208 enabling the shaft and thus the razor head to move in all three planes with the partially spherical surfaces being slightly spaced apart to provide an air gap since the resilient resistance to movement is provided by the resilient body 208.

Figure 23:
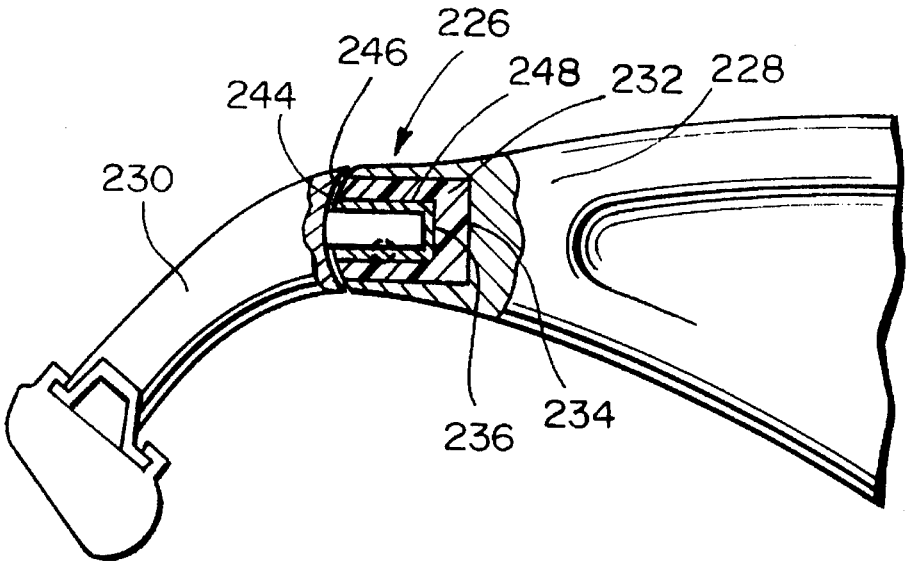
FIG. 23 is a fragmental sectional view of a resilient connection in which the razor head is separable from the handle.
Figure 24:
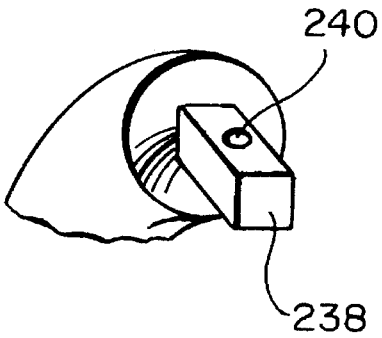
FIG. 24 is a fragmental perspective view of the end of the razor head which engages the handle.
Figure 25:
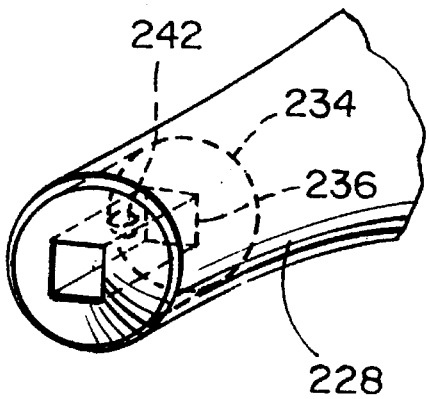
FIG. 25 is a fragmental perspective view of the end of the handle which receives the razor head illustrated in FIG. 24.
Figure 26:
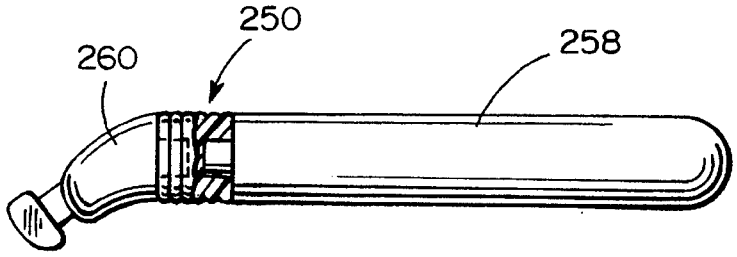
FIG. 26 is a side elevational view with portions of a resilient connection illustrated in section for use with a razor having a generally rectangular cross-sectional configuration of the handle and razor head.
Figure 27:
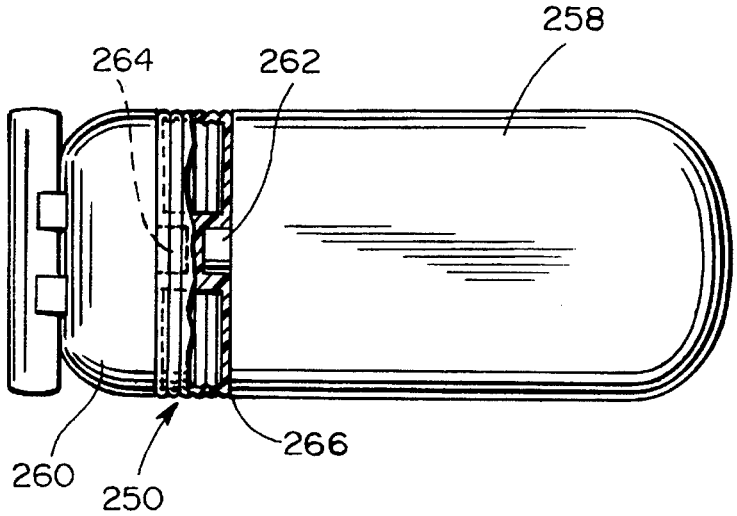
FIG. 27 is a top plan view of the razor with the resilient connection illustrated partially in section.
Figure 28:
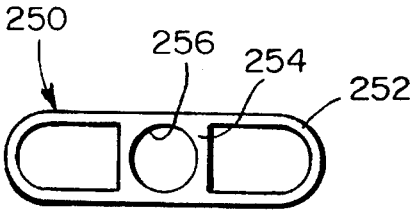
FIG. 28 is an end elevational view of the resilient connection of FIGS. 26 and 27.
Figure 29:
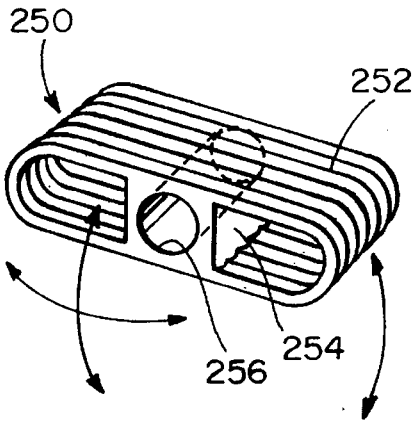
FIG. 29 is a perspective view of the resilient connection illustrating the capability of resilient movement of the razor head in relation to the handle in three planes.

FIGS. 23–25 illustrate a separable or detachable resilient connection 226 between handle 228 and razor head 230 and which includes a resilient body 232 received in a cavity 234 in the handle with the resilient body being bonded to the cavity 234 and including an internal recess 236 telescopedly receiving a projection 238 on the razor head 230 with the projection including a ball detent 240 incorporated therein which engages with a corresponding recess 242 in the recess 236. In this construction, the end of the razor head 230 may have a partially spherical surface 244 which corresponds to an end surface 246 on the handle 228. As indicated, the projection 238 and the recess 236 are of square or noncircular configuration to enable the razor head 230 to move in any direction in any of the three planes by virtue of the resilient body 232. As illustrated in FIG. 23, a rigid sleeve of brass or similar material 248 is provided as a liner for the resilient body 232 to provide a structure for the detent or recess 242 which receives the spring ball 240. This not only enables the razor head to move in any direction but also enables the razor head to be separated and replaced with a different type of razor head or a razor head with new blades.

FIGS. 26–29 illustrate a resilient connection 250 in the form of a flat oval shaped bellows 252 forming a resilient body with a centrally disposed solid portion 254 having a passageway 256 extending therethrough. The bellows type resilient connection 250 interconnects a handle 258 with a razor head 260 which are of similar flat oval shaped cross-sectional configuration. The end of the handle 158 is provided with a central projection in the form of a dowel 262 and the razor head 260 is provided with a similar projection 264 which telescope into the passageway 256 and are bonded thereto by glue, sonic welding or by any other fixation. The ends of the bellows type body 252 are engaged with and attached to the end surfaces of the handle 258 as at 266 and the end of the resilient bellows is also attached to the end of the razor head 260 by glue, sonic welding or by any other means. The resilient construction of the bellows 252 provides for a high degree of flexibility and resiliency in each direction and the ends of the bellows may be glued as indicated or they may be snapped over the handle and razor head respectively.

The various embodiments of the invention disclosed in detail can be used with various types of razors and secured in place by well known bonding arrangements and the physical characteristics of the resilient bodies forming the resilient connections may be varied for varying the resilient resistance to movement of the razor head in the three planes and in each of the three planes. This structure provides the razor head and the blade or blades thereon the capability of exerting the required and optimum pressure against the anatomical skin surface being shaved when the razor head is properly oriented with the resilient connection enabling the razor head to be oriented in the optimum relation even if the handle is not in the optimum position which is normally required when a rigid connection is provided between the handle and razor head. This optimum pressure exerted and optimum angular position is accomplished by the capability of the razor head moving with equal facility and with equal resistance to such movement in all directions.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A non-motor driven razor comprising a handle by which the razor can be gripped, handled and manipulated when shaving hair from an anatomical skin surface, a razor head having a razor blade mounted thereon for movement of the head and blade solely in a transverse edgewise direction of the blade along the anatomical skin surface in transverse perpendicular relation to hair shafts projecting from the anatomical skin surface, and a resilient connection between the razor head and handle, said resilient connection enabling resilient movement of the razor head in relation to the handle in all directions with resilient resistance to such movement occurring in all directions.

2. The razor as defined in claim 1 wherein said resilient connection includes a resilient member enabling resilient movement of the razor head in the X, Y and Z planes and enables movement of the razor head in each of those planes, said resilient connection providing resistance to movement of the razor head to exert optimum force of the razor blade into engagement with the surface being shaved when the orientation of the razor blade is in optimum relation to the surface being shaved.

3. The razor as defined in claim 1 wherein said resilient connection includes a resilient body interposed between the handle and razor head and being connected to each of the razor handle and head.

4. The razor as defined in claim 3 wherein said body is generally cylindrical in configuration and provided with end recesses telescopedly receiving and being bonded to adjacent ends of the handle and razor head.

5. The razor as defined in claim 4 wherein each recess in the resilient body includes an axial projection received in cavities in the handle and razor head to increase the surface area of bonding.

6. The razor as defined in claim 3 wherein said resilient body includes axial projections on each end with each axial projection being barbed for insertion into and locking engagement with a corresponding recess in an end of the handle and an end of the razor head.

7. The razor as defined in claim 3 wherein the external surface of said resilient body is accordion shaped.

8. The razor as defined in claim 3 wherein said resilient body includes a passageway therethrough, said handle including a living shaft extending through the passageway and connected to the razor head.

9. The razor as defined in claim 3 wherein said resilient body includes a recess in each end, an end of the handle and an end of the razor head including a barb shaped projection extending into and bonded to the recesses in the resilient body.

10. The razor as defined in claim 3 wherein said resilient body has a passage therethrough, an end of the handle and end of the razor head including a recess aligned with the passageway and a living shaft extending through the passageway and into the handle and razor head.

11. The razor as defined in claim 10 wherein an external portion of the handle is externally threaded and provided with a threaded nut thereon for engagement with an end of the resilient body to exert compressive pressure thereon for varying the resilient characteristics of the body.

12. The razor as defined in claim 3 wherein said resilient body is defined by a plurality of circular resilient discs having selected values of resiliency and flexibility, said discs being mounted on a living shaft, said shaft extending into recesses in the handle and head and bonded thereto with the discs being bonded to each other, to the shaft and to the handle and head.

13. The razor as defined in claim 1 wherein said resilient connection includes the unitary construction of the handle and razor head of plastic resilient material having a reduced cross-sectional configuration defined by a peripheral groove integral with the handle and razor head to form a plastic living hinge between the handle and head, said resilient connection, adjacent portion of the handle and adjacent portion of the razor head being of transversely solid plastic material throughout the length thereof.

14. The razor as defined in claim 1 wherein said resilient connection includes a resilient body positioned in a recess in an end of the handle, a rigid shaft extending through the resilient body and being anchored in a passageway in the razor head whereby the resilient body enables movement of the shaft and razor head in relation to the handle.

15. The razor as defined in claim 1 wherein said resilient connection includes a resilient sleeve in the handle, said resilient sleeve having a rigid liner provided with a radial recess, said head including a projection rigid with the head telescoped into the liner and including a ball detent for engaging the recess to enable separation of the razor head with the resilient body enabling resilient movement of the razor head in any direction.

16. The razor as defined in claim 1 wherein said razor head and handle include a transverse elongated, oval shaped configuration with generally parallel top and bottom surfaces, said resilient connection including a correspondingly shaped resilient body of hollow construction with the periphery of the resilient body defining a bellows, said resilient body including a solid central portion having oppositedly facing cavities, said handle and razor head including projections telescoped into the cavities and being bonded thereto to provide a resilient connection for movement of the razor head in any direction and in any plane.

* * * * *